US007538752B2

(12) United States Patent
Chou et al.

(10) Patent No.: US 7,538,752 B2
(45) Date of Patent: May 26, 2009

(54) SOURCE DRIVER, SOURCE DRIVER ARRAY, AND DRIVER WITH THE SOURCE DRIVER ARRAY AND DISPLAY WITH THE DRIVER

(75) Inventors: Chun-Yi Chou, Hsinchu (TW); Alex Tang, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 625 days.

(21) Appl. No.: 10/893,205

(22) Filed: Jul. 16, 2004

(65) Prior Publication Data

US 2005/0264546 A1 Dec. 1, 2005

(30) Foreign Application Priority Data

May 27, 2004 (TW) ..... 93115037 A

(51) Int. Cl.
*G09G 3/36* (2006.01)
*G09G 3/30* (2006.01)

(52) U.S. Cl. ..... 345/98; 345/99; 345/100; 345/87

(58) Field of Classification Search ..... 345/211, 345/212, 213, 204, 87–104
See application file for complete search history.

(56) References Cited

U.S. PATENT DOCUMENTS

| | | | | |
|---|---|---|---|---|
| 6,459,417 | B1 * | 10/2002 | Orisaka et al. | 345/98 |
| 6,856,373 | B2 * | 2/2005 | Sekido et al. | 349/181 |
| 7,098,901 | B2 * | 8/2006 | Nakano et al. | 345/204 |
| 2003/0001808 | A1 * | 1/2003 | Sakuma et al. | 345/87 |
| 2003/0218588 | A1 * | 11/2003 | Kumagai et al. | 345/87 |
| 2004/0032405 | A1 * | 2/2004 | Aoki et al. | 345/211 |
| 2004/0164943 | A1 * | 8/2004 | Ogawa et al. | 345/92 |
| 2005/0012705 | A1 * | 1/2005 | Akahori | 345/99 |

* cited by examiner

*Primary Examiner*—Sumati Lefkowitz
*Assistant Examiner*—Seokyun Moon
(74) *Attorney, Agent, or Firm*—J.C. Patents

(57) ABSTRACT

A source driver, a source driver array, and a driver circuit with the source driver array and a display with the driver are provided in the invention. These devices are improved by receiving a position code signal through a start pulse generating circuit, which also accordingly generate a start pulse. The invention can improve the problem that the highest operation frequency of a flat panel display being restricted by the start pulse and further improve the cost of the conventional display for increasing the operation frequency.

40 Claims, 8 Drawing Sheets

SOURCE DRIVER, SOURCE DRIVER ARRAY, AND DRIVER WITH THE SOURCE DRIVER ARRAY AND DISPLAY WITH THE DRIVER

CROSS-REFERENCE TO RELATED APPLICATION

This application claims the priority benefit of Taiwan application serial no. 93115037, filed on May 27, 2004.

BACKGROUND OF THE INVENTION

1. Field of the Invention

This invention relates to a display and its driving circuit, and more particularly, the invention relates to a source driver, a source driver array, and driving circuit and display with the array.

2. Description of Related Art

Liquid crystal Display (LCD) has the characteristics being light, thin, small volume, low radiation, and saving power. These characteristics allow the space used in office area or home area to be saved, and also reduce the eye fatigue due to a long time of viewing on it. Therefore, in the planar display apparatus, LCD has the potential to replace the conventional CRT. However, as image resolution is more and more requested, it means that the data size for each frame of image is accordingly getting large. Therefore, the operation frequency of drivers for the planar display apparatus also increases.

Referring to FIG. 1, it is a block diagram, schematically illustrating a conventional AMTFT (Active Matrix Thin Film Transistor (TFT)) LCD 100. This LCD 100 includes a TFT LCD panel 101, a source driver array 102 composed of several source drivers, a gate driver array 103 composed of several gate drivers, a power supplier 104, and a timing controller 105. The timing controller 105 supplies the operation clock CLK (see FIG. 1) to the source drivers of the source driver array 102 and the gate drivers of the gate driver array 103. At the same time, the timing controller 105 issues a vertical synchronous signal to the gate driver array 103, and issues a horizontal synchronous signal to the source driver array 102 and the gate driver array 103. For the descriptions, the control signals for the source driver array 102 and the gate driver array 103 are respectively called the source control signal and the gate control signal, as shown in FIG. 1. The displaying data to be displayed on the TFT LCD panel 101 are first entering the timing controller 105, and then are sent to the source driver array 102 via the timing controller 105. The source drivers in the source driver array 102 obtain the display data, and the displaying data is converted by a digital-to-analog converter in accordance with the horizontal synchronous signal supplied by the timing controller 105. After then, the source drivers export a gray-level voltage to the TFT LCD panel 101 for displaying image.

Referring to FIG. 2, it is a drawing, schematically illustrating a coupling relation between a timing controller 210 and a source driver array 220 in a conventional active-matrix TFT LCD. This source driver array 220 includes n number of source drivers (2201~220*n*). The timing controller 210 connects with each of the source drivers 2201~220*n*, and respectively supplies a start pulse signal DIO1, a operation clock CLK, a display data signal DATA and a horizontal latch signal LD to each of the source drivers 2201~220*n*, as shown in FIG. 2. The operation clock CLK, the display data signal DATA and the horizontal latch signal LD are transmitted in the same bus, and each of the source driver 2201~220*n* is connected to the bus for receiving signals. The pulse signal DIO1 is then connected by the connection manner of point to point, and is latched according to the operation clock CLK, so as to serve as the control signal for the data signal DATA in sequential distribution. When the line buffer is full in data latch, it then issues a start pulse signal DIO2, for supplying to the next source driver in use. The expansion of display image is achieved by using this manner of data in a series sequence.

FIG. 3 is a block diagram, schematically illustrating a conventional source driver of the Active Matrix Thin Film Transistor LCD. This source driver 300 includes a shift register 310, a sampling register 320 coupled to a data latch unit 330, a hold register 340, a level shift 350, a digital-to-analog converter (DAC) unit 360 and a output buffer 370. The DAC unit 360 is coupled to a gamma voltage generator 380.

The shift register 310 receives a start pulse signal DIO1 being externally input. The start pulse signal DIO1 is latched, so as to serve as the control signal for data sequential distribution. The display data signal DATA is then transmitted to the sampling register 320 via the data latch unit 330 and the data bus. This hold register 340 also receives the horizontal latch signal (LD). After the level shift unit 350 adjusts voltages of the display data signals, the signals are transmitted to the DAC unit 360. The Gamma voltage generator 380 receives a gamma voltage from external, and accordingly exports an output to the DAC unit 360 to serve as a reference for adjusting the analog signal. The adjusted display data signal is transmitted to the TFT LCD panel via the output buffer 370.

However, the bottleneck of this method is the path difference between the start pulse signal DIO1 at the receiving terminal and the operation clock signal CLK. It often causes latch error of the start pulse signal, and then limits the maximum operation frequency. The current method can only reach to about 100 MHz.

Referring to FIG. 4, it is a timing chart, schematically illustrating the timing sequence of the conventional source driver of an active TFT LCD. As shown in FIG. 4, at the time T1, the source driver receives the horizontal latch signal (LD). At the time T2, the source driver receives the start pulse signal DIO1, and performs the latch according to the operation clock CLK, so as to serve the control signal of the data sequential distribution. When the line buffer is data latch full, it sends a start pulse signal DIO2 as the output for use by the next source driver, such as at the time T3. The scheme of one after one in sequence continues until the display data of one horizontal line are completely latched. At this moment, the timing controller issues the horizontal latch signal LD to convert the data in line buffer from digital to analog, and then a gray level voltage is exported to the TFT LCD panel.

SUMMARY OF THE INVENTION

It is an objective of the present invention to provide a source driver, a source driver array, and driving circuit with this array, and a display with the driving circuit, wherein the start pulse signal is improved. As a result, the conventional issue about the limitation of maximum operation frequency of the panel display driver due to the start pulse signal can be improved. Also and, the additional cost to raise the operation frequency in the conventional scheme, such as two-bus architectures, can be saved.

With respect to the objective, the invention provides a source driver, suitable for use to drive a display panel of a displaying apparatus. The source driver receives a display timing information provided from a timing controller. The source driver includes a start pulse generating circuit, used to receive a position code signal, and generates a start pulse signal based on the position code signal, so as to serve as a signal of data distribution control of a display data signal in the display timing information.

For the foregoing source driver, in one embodiment, for the source-driver encoding signal (POS) being the x-th one with respect to the source driver in a source driver array, the source-driver encoding signal (POS) has the value of (x−1) *k. And, after counting value is equal to the source-driver encoding signal (POS), it starts to receive the display data signal in the display timing data. And, k is defined as the number of data needed to be latched by the source driver. The number of data to be latched by the source driver is the number of output channels of the source driver.

For the foregoing source driver, in one embodiment, for the source-driver encoding signal (POS) being the xth one with respect to the source driver in a source driver array, the source-driver encoding signal (POS) has the value of (x−1) *k. And, after counting value is equal to the source-driver encoding signal (POS), it starts to receive the display data signal in the display timing data. And, k is defined as the number of data needed to be latched by the source driver. The number of data to be latched by the source driver is the number of output channels of the source driver.

For the foregoing source driver in an embodiment, after the data of a horizontal line of the display data signal in the display timing data is completely latched, the timing controller issues a horizontal latch signal, so as to convert the data of the horizontal line from digital to analog and export the data to the display panel of the displaying device.

For the source driver in an embodiment, the start pulse generating circuit includes a start-code detection circuit, a synchronous counter, a decoding circuit and a digital comparator. The start code detection circuit is used to receive the display timing data transmitted from the timing controller, and to detect whether or not a horizontal latch signal appears in the display timing data. After the horizontal latch signal is detected, it is further detected whether or not a start code appears in the display data signal of the display timing data, so as to accordingly generate an enabling signal. The synchronous counter is coupled with the start code detection circuit, for receiving the enabling signal and the horizontal latch signal, and an operation clock signal, in which the horizontal latch signal causes a clear on the synchronous counter to be 0, and the counter starts to count according to the enabling signal. The decoding circuit is used to receive the position code signal, so as to accordingly generate a source-driver encoding signal (POS). The digital comparator is coupled to the synchronous counter and the decoding circuit, so as to compare value of the source-driver encoding signal (POS) with the value in the synchronous counter. It starts to receive the display data signal of the display timing data if the counting value is equal.

The invention provides a source driver array, suitable for use in a display panel of a displaying apparatus. The source driver array includes a plurality of source drivers, and each of the source drivers is coupled to a timing controller, so as to receive a display timing data. Each of the source drivers receives the corresponding one of a position code signal, in which the corresponding position code signal with respect to each source driver is determined according to a driving sequence of the source drivers in the source-driver array. According to the position code signal, a signal used as a data distribution control of the display data signal in the display timing data is transmitted to the display panel.

The invention provides a driving circuit, suitable for use in a display panel of a displaying apparatus, including a timing controller and a source driver array. The source driver array includes a plurality of source drivers. The timing controller is coupled with each of the source divers and provides a display timing data to each of the source drivers. Each of the source drivers receives a corresponding position code signal. The position code signal with respect to each source driver is determined according to a driving sequence of the source drivers in the source-driver array. According to the position code signal, a signal used as a data distribution control of the display data signal in the display timing data is transmitted to the display panel.

In the foregoing source driver array, each of the source drivers including a start pulse generating circuit is used to receive the position code signal and accordingly generate a start pulse signal, to be used as the signal of the data distribution control of the display data signal of the display timing data.

The invention provides a display apparatus, having a display panel and a driving circuit. The driving circuit includes a timing controller and a source driver array. The source driver array includes a plurality of source drivers. The timing controller is coupled with each of the source drivers and provides a display timing information to each of the source drivers. Each of the source drivers receives a corresponding position code signal. The corresponding position code signal with respect to each source driver is determined according to a driving sequence of the source drivers in the source-driver array. According to the position code signal, the signal used as the data distribution control of the display data signal in the display timing data is transmitted to the display panel.

The foregoing display apparatus is an active-drive display apparatus. In the embodiment, the display apparatus can be an amorphous silicon TFT LCD apparatus, a low temperature polysilicon TFT LCD apparatus, a liquid crystal on Silicon (LcoS) display apparatus, or an organic light-emitting diode (OLED) display apparatus.

BRIEF DESCRIPTION OF DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF PREFERRED EMBODIMENTS

The invention is to provides an improved structure for a start pulse signal, so as to improve the conventional problems about the limitation of the maximum operation frequency of the panel display driver by the start pulse signal. And further, the cost due to the structure in the conventional scheme for raising the operation frequency can be saved.

For easy descriptions, the LCD is described by taking the AMTFT LCD as the example. However, the person skilled in the art knows that the present invention is a driving circuit for the display apparatus, and is suitable for use in various display apparatus, such as amorphous silicon TFT LCD display apparatus, a low temperature polysilicon TFT LCD apparatus, a liquid crystal on Silicon (LcoS) display apparatus, or an organic light-emitting diode (OLED) display apparatus.

Figure 5:
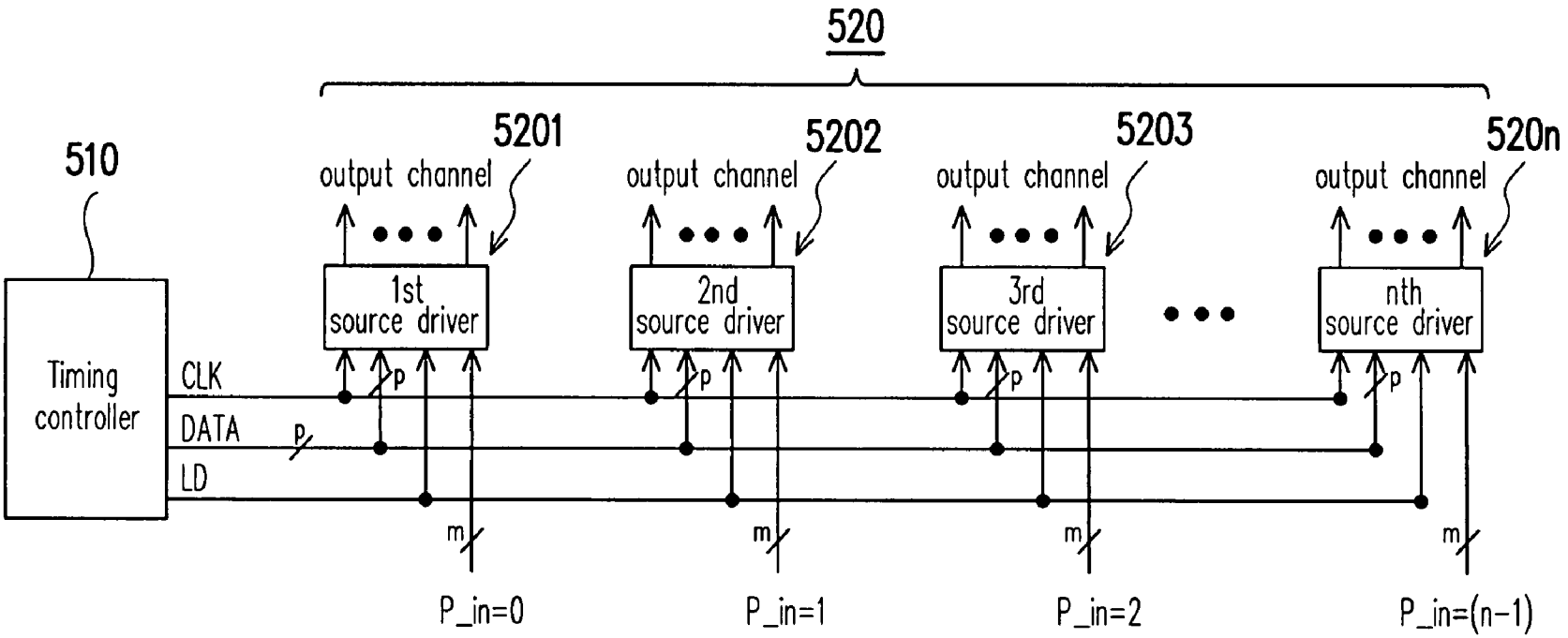
FIG. 5 is a drawing, schematically illustrating a coupling relation between a timing controller and a source driver array in an active-matrix TFT LCD, according to an embodiment of the invention.

In FIG. 5, it is a drawing, schematically illustrating a coupling relation between a timing controller 510 and a source driver array 520 in an active-matrix TFT LCD, according to an embodiment of the invention. The source driver array 520 includes n number of source drivers (i.e. 5201-520*n* in drawing). The timing controller 510 is coupled with each of the source drivers 5201-520*n*, and respectively provides an operation clock signal CLK, a display data signal DATA (for example P bits in size), and a horizontal latch signal LD to each of the source drivers 5201.about.520*n*. The operation clock signal CLK, the display data signal DATA and the horizontal latch signal (LD) are in the same bus, and the each of the source drivers 5201.about.520*n* is coupled to the bus to receive the signals. In one embodiment, the operation clock CLK, the display data signal DATA and the horizontal latch signal LD can be differential voltage signals or transistor-transistor logic (TTL) voltage signals. Each of the source drivers 5201-520*n* has a plurality of output channels, exporting to the LCD panel.

Figure 1:
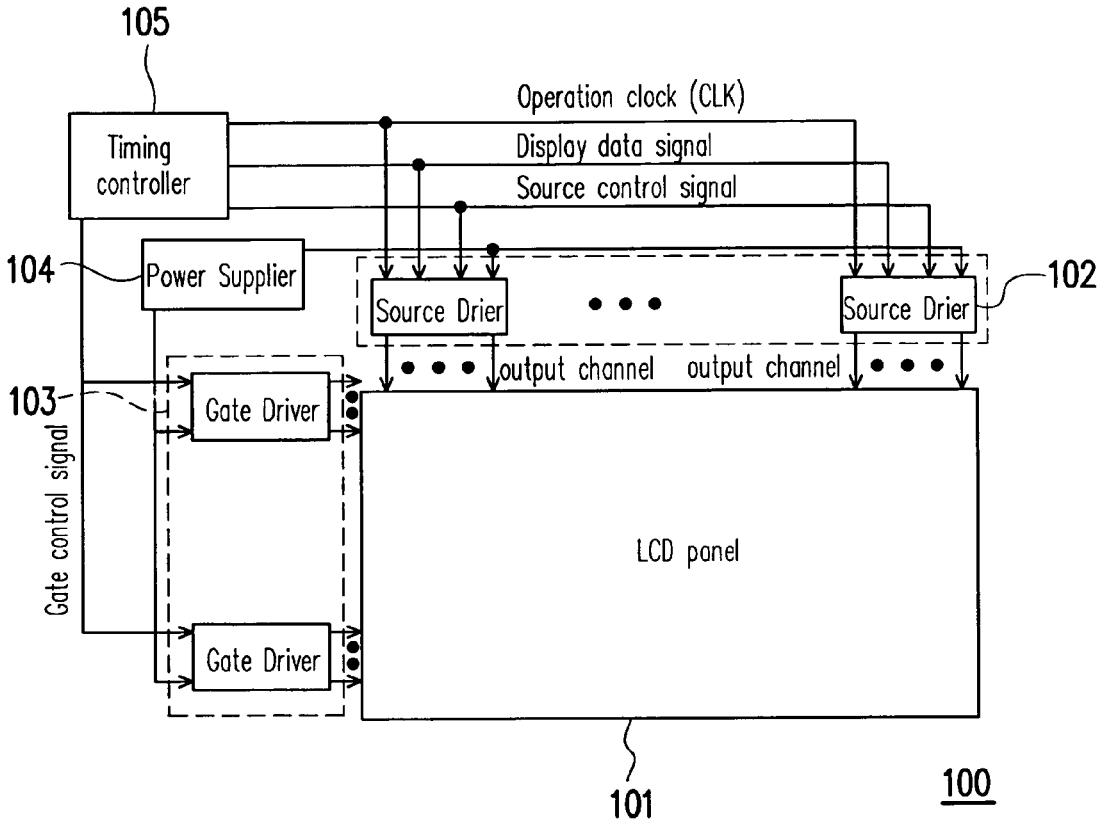
FIG. 1 (PRIOR ART)
FIG. 1 is a block diagram, schematically illustrating a conventional AMTFT (Active Matrix Thin Film Transistor (TFT)) LCD.
Figure 2:
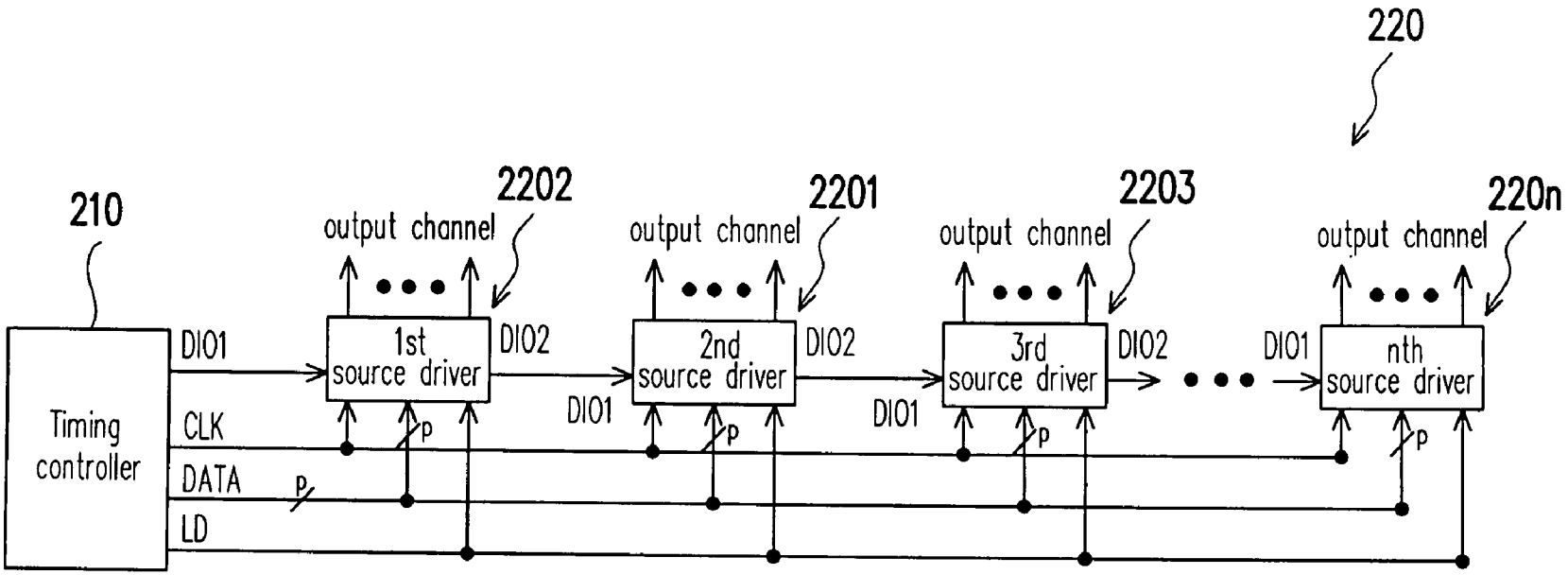
FIG. 2 (PRIOR ART)
FIG. 2 is a drawing, schematically illustrating a coupling relation between a timing controller and a source driver array in a conventional active-matrix TFT LCD.
Figure 3:
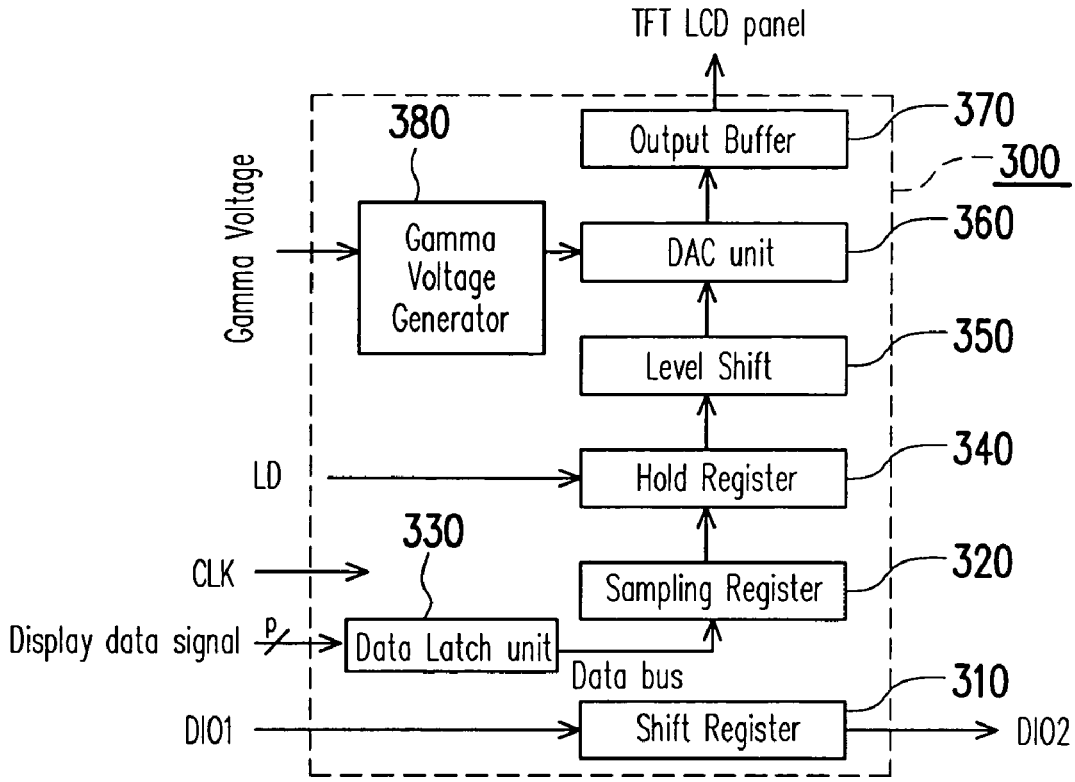
FIG. 3 (PRIOR ART)
FIG. 3 is a block diagram, schematically illustrating a conventional source driver of the Active Matrix Thin Film Transistor LCD.
Figure 4:
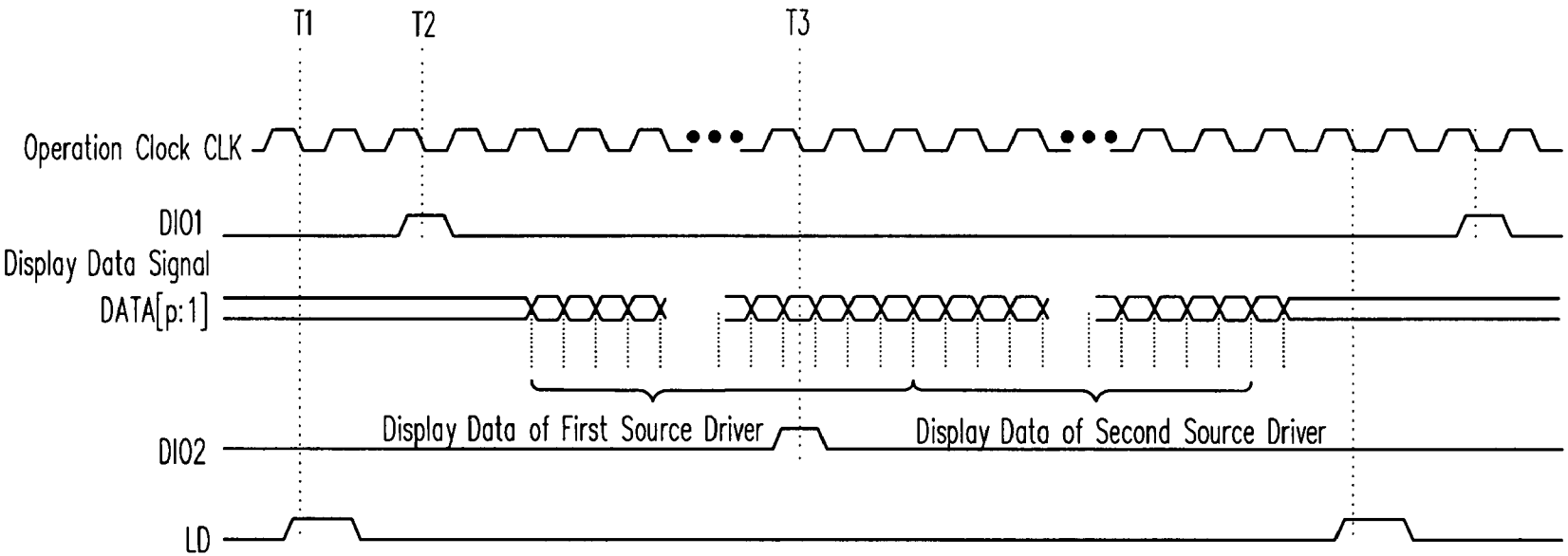
FIG. 4 (PRIOR ART)
FIG. 4 is a timing chart, schematically illustrating the timing sequence of the conventional source driver of an active TFT LCD.

The difference of the embodiment with the conventional scheme in FIG. 3 includes that the timing controller 510 only exports the operation clock signal CLK, the display data signal DATA and the horizontal latch signal LD to each of the source drivers 5201-520*n*, but not exports the start pulse signal DIO1. Each of the source drivers 5201-520*n* either needs not to export the start pulse signal DIO2 for use in the next stage of source diver. In addition, the difference of the embodiment with the conventional scheme in FIG. 3 further includes, for example, an additional input of position code signal P in m bits.

The number of bits for the position code signal P is determined according to the actual number of source drivers 5201-520*n*, which are needed to be defined. In the embodiment, since the needed number of the source drivers is n, the number m of bits for the position code signal P must be greater than or equal to a number, which can represent a number of bits for the number n by binary. That is to say the number m of bits for the position code signal satisfies the condition, $m \geqq \log_2(n)$, where m is an integer. The position code signal P, received by each of the source drivers 5201-520*n*, is determined the arranging sequence order of the source drivers designed in the source driver array and is described by m bits. The received position code signal P is decimal 0 for the source driver 5201, as shown in Figure. The received position code signal P is decimal 1 for the source driver 5202. According to the arranging sequence of the source drivers, the similar situation is from left to right. As a result, the received position code signal P is decimal n−1 for the source driver 520*n*. However, the foregoing design of the position code signal P is just an example of the invention.

In alternative design, it can be based on a specific arranging sequence of the source drivers 5201-520*n* to be driven in the source driver array 520 to adjust the position code signal P. It cannot be achieved for these features by the conventional manner about arranging the source drivers one after one, and the start pulse signal DIO being transmitted from a previous source driver to the next source driver. However, the specific arranging sequence described in the invention, for example for the n number of source drivers in the source driver array, can first drive the odd number of the source drivers and drive the even number of the source drivers later. This is a possible design according to the design of embodiment.

Figure 6:
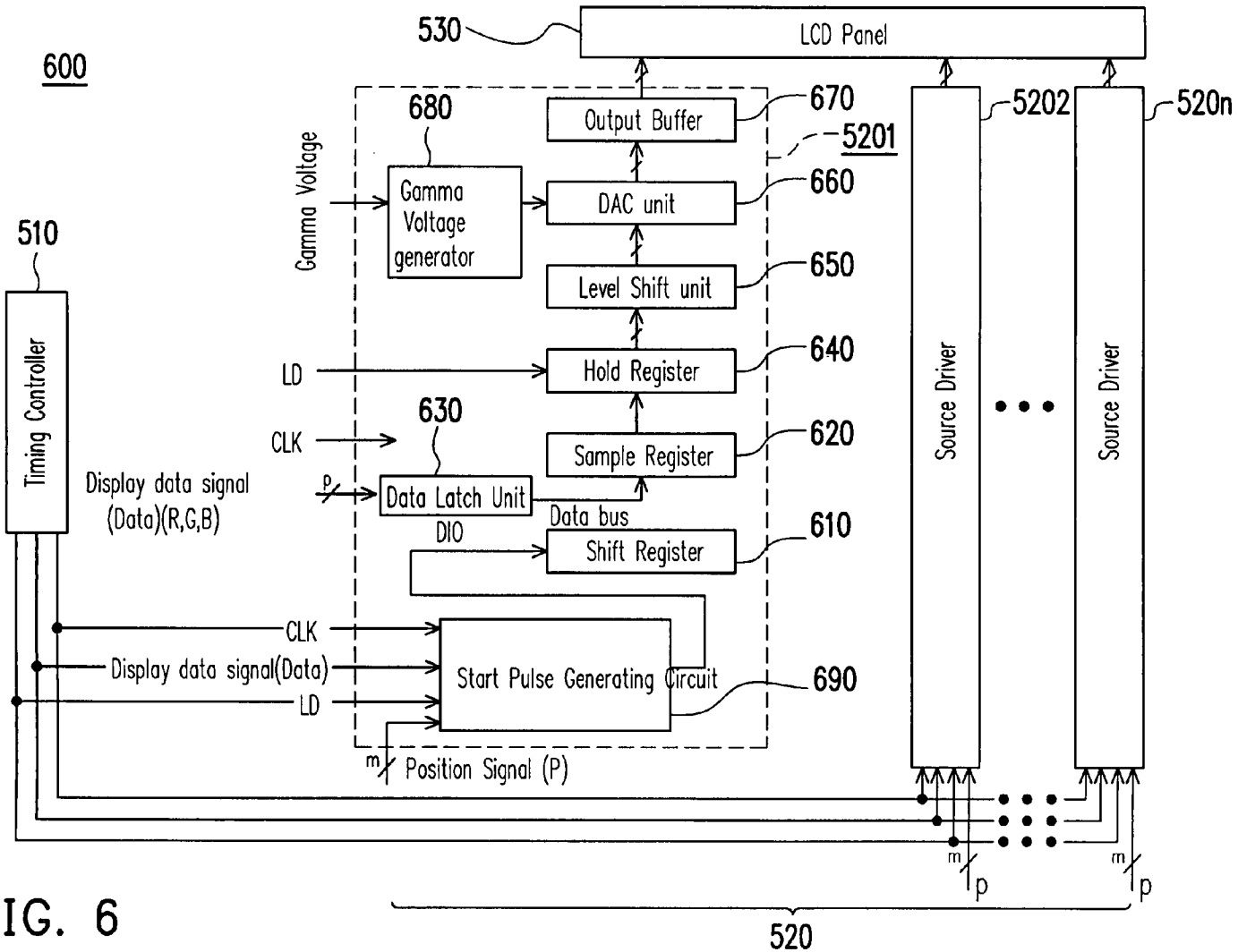
FIG. 6 is a block diagram, schematically illustrating an AMTFT LCD, including a timing controller, a source driver array, and a LCD display panel, according to the embodiment of the invention.

Referring to FIG. 6, it is a block diagram, schematically illustrating an AMTFT LCD 600, including a timing controller 510, a source driver array 520, and a LCD display panel 530, according to the embodiment of the invention. This source driver array 520 includes n number of source drivers 5201-520*n*. For describing an embodiment of the source driver of the invention, only the source driver 5201 of the source driver array 520 is described. The other source drivers 5202-520*n* are in similar scheme.

This source driver 5201 includes a shift register 610, a sampling register 620 coupled to a data latch unit 630, a hold register 640, a level shift 650, a digital-to-analog converter (DAC) 660, an output buffer 670, and a start pulse generating circuit 690. The DAC 660 is coupled to a gamma voltage generator 680.

The shift register 610 receives the start pulse signal DIO generated by the start pulse generating circuit 690, so as to latch the start pulse signal DIO1 to serve as a control signal of data sequence distribution. The display data signal DATA is transmitted to the sampling register 620 via the data latch unit 630 and the data bus, and is further transmitted to the hold register 640. The hold register 640 also receives the horizontal latch signal (LD). After the voltage level of the display data signal is adjusted by the level shift unit 650, the signal is transmitted to the DAC unit 660. The gamma voltage generating apparatus 680 receives an external gamma voltage, which is accordingly transmitted to the DAC unit 660 and serves as a reference for adjusting the analog signal. Then, the adjusted display data signal is transmitted to the TFT LCD panel 530 via the output buffer 670.

Figure 7:
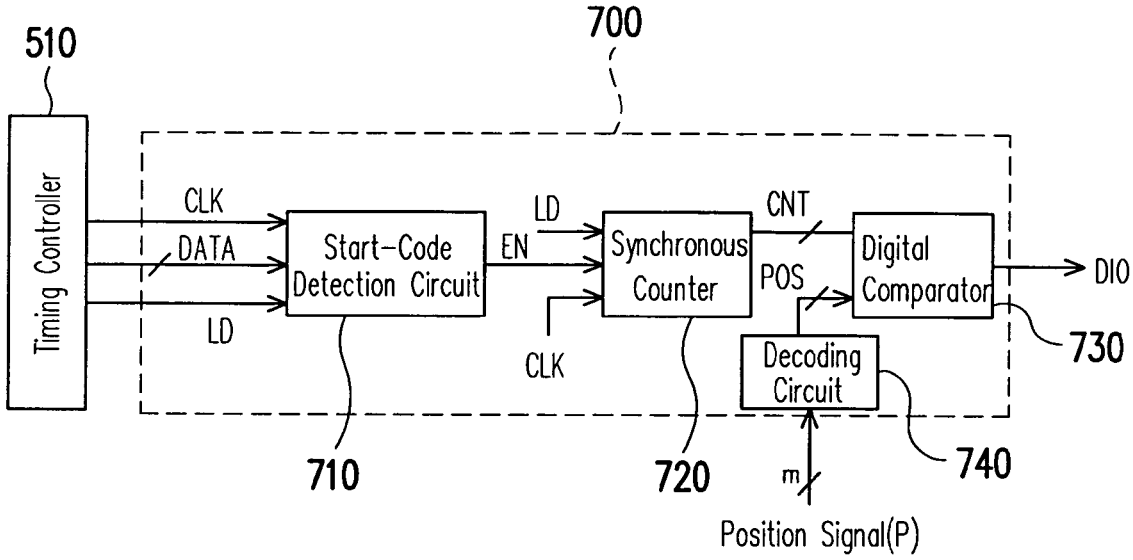
FIG. 7 is a circuit block diagram, schematically illustrating a start pulse generating circuit of the source driver, according to an embodiment of the invention.

Referring to FIG. 7, it is a circuit block diagram, schematically illustrating a start pulse generating circuit of the source driver, according to an embodiment of the invention. The start pulse generating circuit 700 includes, for example, a start-code detection circuit 710, a synchronous counter 720, a digital comparator 730, and a decoding circuit 740. The start-code detection circuit 710 receives the operation clock signal CLK from the timing controller 510, the display data signal DATA and the horizontal latch signal LD. An enabling signal EN is generated according to these signals, and transmitted to the synchronous counter 720 being coupled, so as to be used by the synchronous counter 720 for starting to count. The synchronous counter 720 also receives the horizontal latch signal LD and the operation clock signal CLK.

The operations for the start-code detection circuit 710 and the synchronous counter 720 are, for example, as follows. While in start, after the start-code detection circuit 710 receives the horizontal latch signal LD, it starts to detect whether or not a start code (S_code) appears in the display data signal DATA, and the LD signal also simultaneously clear the synchronous counter to be 0. After the start-code detection circuit 710 has detected that the start code (S_code)

appears in the display data signal DATA, the start-code detection circuit 710 accordingly generates the enabling signal EN, used by the synchronous counter 720 for starting to count. In this embodiment, the synchronous counter 720 can be triggered by rising edge. However, it can be understood by the ordinary skilled artisans that the trigger can also be a falling edge. The counting result CNT of the synchronous counter 720 is transmitted to the digital comparator 730.

The decoding circuit 740 receives a position code signal P in multiple bits, such as m bits, and accordingly generates a source-driver encoding signal (POS), which is further transmitted to the digital comparator 730. Since the source driver array includes several source drivers, such as the source driver array 520 as shown in FIG. 6, with n number of source driver 5201-520*n*, the position code signal P is determined by the position of each of the source drivers in the source driver array. For example, with respect to the first source driver of the source driver array, the position code signal P is set as decimal 0. According to the arranging sequence of the source drivers, the position code signal P is respectively defined for each of the source drivers. Certainly, as described in alternative embodiment, the value of the position code signal P can be adjusted according to a specific sequence.

Taking the example of the first source driver and the position code signal P being defined as 0 for description, when the received position code signal P is 0, the source-driver encoding signal (POS) with 0 is transmitted to the digital counter 730. After then, when the counting result CNT of the synchronous counter 720 is 0, the start pulse signal DIO is issued to the shift register. And for the second source driver as an example with the position code signal P being defined as 1, and the source-driver encoding signal (POS) being k, when the counting result CNT of the synchronous counter 720 is k, the start pulse signal DIO is issued to the shift register. With the same principle, for the x-th source driver and position code signal P being defined as x−1, then the source-driver encoding signal (POS) is (x−1)*k, which is x−1 times k. When the counting result CNT of the synchronous counter 720 is (x−1)*k, a start pulse signal DIO is issued to the shift register. Here; k is defined as the number of data to be latched in a source driver, which is also the number of output channels in each of the source drivers. After data of a horizontal line are completely latched, the timing controller 510 at this moment issues the horizontal latch signal LD. After the data in, for example, a line buffer is converted from digital to analog, a gray level voltage is exported to the LCD panel.

Figure 8:
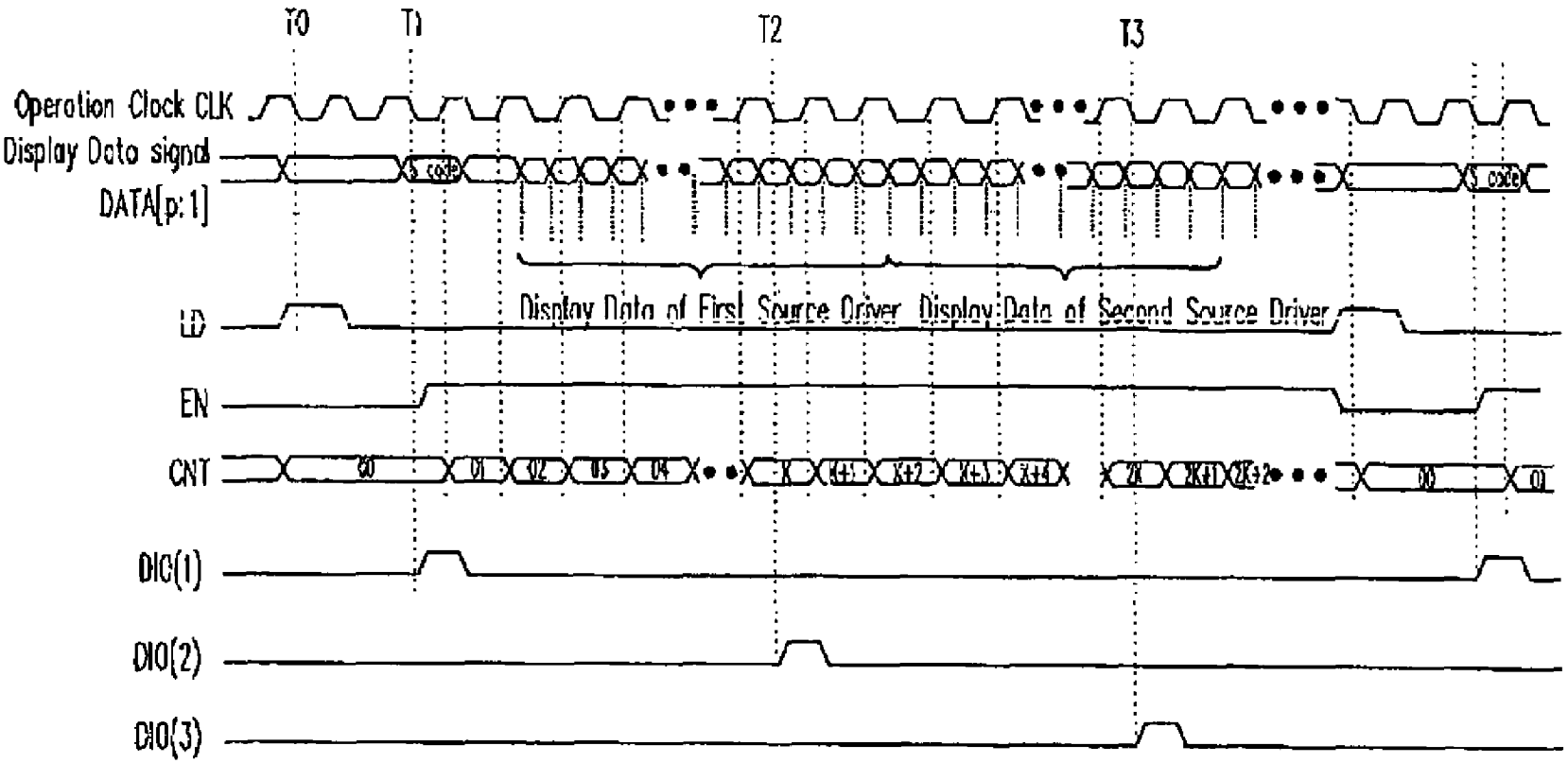
FIG. 8 is a timing chart, schematically illustrating the signal of the start pulse generating circuit in FIG. 7.

Referring to FIG. 8, it is a timing chart, schematically illustrating the signal of the start pulse generating circuit in FIG. 7. When it starts, the start-code detection circuit 710 receives the horizontal latch signal LD at time T0, and then starts to detect whether or not a start code (S_code) appears in the display data signal DATA, and the LD signal also simultaneously clear on the synchronous counter to be 0. The start code (S_code) can be designed in different settings, according to different type of display apparatus, and usually, it is issued after the horizontal latch signal LD has started for a few of clock cycles.

When the start-code detection circuit 710 has detected the start code (S_code) of the display data signal DATA at time t1 as shown in FIG. 8, the start-code detection circuit 710 then accordingly generates an enabling signal EN for the synchronous counter 720 to start to count, wherein the enabling signal EN is changed from a low logic level to a high logic level. In this embodiment, the synchronous counter 720 is a type triggered by rising edge. However, if the synchronous counter 720 is a type triggered by falling edge, then the enabling signal EN can trigger the synchronous counter 720 when its logic level is changed from high logic level to low logic level after start code (S_code) of the display data signal DATA has been detected.

The counting result CNT of the synchronous counter 720 is transmitted to the digital comparator 730. The first source driver with the position code signal being set by 0 is taken as the example for description. Since the position code signal P is 0, the source-driver encoding signal (POS) with 0 is transmitted to digital comparator 730. After then, when the counting result CNT of the synchronous counter 720 is 0, then the start pulse signal DIO(1) is issued to the shift register of the first source driver. For the second source driver as the example with the position code signal P being defined by 1, then, the source-driver encoding signal (POS) is k. When the counting result CNT of the synchronous counter 720 is k, at time T2 in FIG 8, then the start pulse signal DIO(2) is issued to the shift register of the second source driver. At time T3, the start pulse signal DIO(3) is issued to the shift register of the third source driver. With the same principle, for the x-th source driver and position code signal P being defined as x−1, then the source-driver encoding signal (POS) is (x−1)*k, which is (x−1) times k. When the counting result CNT of the synchronous counter 720 is (x−1)*k, a start pulse signal DIO is issued to the shift register. Here, k is defined as the number of data to be latched in a source driver, which is also the number of output channels in each of the source drivers. After data of a horizontal line are completely latched, the timing controller 510 at this moment issues the horizontal latch signal LD. After the data in, for example, a line buffer is converted from digital to analog, a gray level voltage is exported to the LCI) panel.

The driving circuit of panel displaying apparatus of the invention can solve the disadvantages that the maximum operation frequency in the conventional driving circuit of panel displaying apparatus is limited by the path difference between the start pulse input signal and the clock signal. The invention includes the following advantages. First, the driving circuit of the panel displaying apparatus of the invention has a relatively high operation frequency in comparing with the conventional driving circuit. In addition, the driving circuit of the invention need no the input of the start pulse signal DIO1. Instead, according to the data latching sequence, each of the source drivers is assigned with a specific position code signal P. Thereby, a start pulse signal with improved structure is provided, so that the conventional issues about the maximum operation frequency being limited by the start pulse signal in the panel displaying apparatus can be effectively solved. Also and, the fabrication cost of the additional structure in conventional manner to raise the operation frequency can be effectively saved.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A driving circuit, suitable for driving a display panel of a displaying apparatus, comprising a timing controller and a source driver array, wherein the source driver array has a plurality of input ends to receive a plurality of position code signals and comprises a plurality of source drivers, the timing controller is coupled with each of the source drivers and provides a display timing data to each of the source drivers, each of the source drivers is correspondingly coupled to one of the input ends of the source driver array and correspondingly receives one of the position code signals, each of the position code signals with respect to each of the source drivers is determined according to a driving sequence of the source drivers in the source driver array, the position code signal is used as a reference for a control signal of data distribution of a display data signal in the display timing data, and then being transmitted to the display panel, all of the position code signals being not provided by the source drivers, and each of the source drivers comprising a start pulse generating circuit, used to receive the position code signal, generate a start pulse signal according to the received position code signal, so as to serve as the control signal of data distribution of the display data signal in the display timing data, wherein the start pulse generating circuit comprises:

a start-code detection circuit, used to receive the display timing data transmitted from the timing controller, and detect whether or not a horizontal latch signal appears in the display timing data, after the horizontal latch signal has been detected, continuously to detect whether or not a start code appears in the display data signal of the display timing data, so as to generate an enabling signal after detecting the start code;

a synchronous counter, coupled to the start-code detection circuit, for receiving the enabling signal, the horizontal latch signal and an operation clock signal, wherein the horizontal latch signal resets a counting value of the synchronous counter to be 0, and starting to count according to the enabling signal;

a decoding circuit, for receiving the position code signal, and accordingly generating a source-driver encoding signal (POS); and a digital comparator, coupled to the synchronous counter and the decoding circuit, so as to compare the source-driver encoding signal (POS) with the counting value of the synchronous counter, wherein if the value of the source-driver encoding signal is equal to the counting value, then the display data signal in the display timing data starts to be received and thus the operation frequency of the source driver is enhanced.

2. The driving circuit of claim 1, wherein the display timing data includes an operation clock signal, a horizontal latch signal, and the display data signal.

3. The driving circuit of claim 2, wherein the operation clock signal, the display data signal, and the horizontal latch signal are differential voltage signal signals.

4. The driving circuit of claim 2, wherein the operation clock signal, the display data signal, and the horizontal latch signal are transistor-transistor logic (TTL) voltage signal signals.

5. The driving circuit of claim 1, wherein the position code signal has a plurality of bits, wherein the number of the bits of the position code signal is determined by the number of the source drivers.

6. The driving circuit of claim 5, wherein the number of the bits of the position code signal is greater than or equal to the value of the number, which represents a number of bits for the number of source drivers by binary.

7. The driving circuit of claim 1, wherein when the position code signal received by the source drivers in the source driver array is used as the control signal of data distribution of the display data signal in the display timing data, the source-driver encoding signal (POS) is generated to serve as a reference to start to receive the display data signal in the display timing data.

8. The driving circuit of claim 7, wherein for the source-driver encoding signal (POS) with respect to an x-th one of the source drivers of the source driver array, a value of the source-driver encoding signal (POS) is $(x-i)*k$, wherein after the counting value is equal to the value of the source-driver encoding signal (POS), the one of the source drivers starts to receive the display data signal in the display timing data, wherein k represents the number of data to be latched in each of the source drivers, and x, i, and k are positive integers.

9. The driving circuit of claim 7, wherein after data of one horizontal line of the display data signal in the display timing data are completely latched, the timing controller issues a horizontal latch signal to cause the data of the horizontal line to have digital-to-analog conversion, and then transmitted to the display panel.

10. A source driver array, suitable for driving a display panel of a displaying apparatus, wherein the source driver array has a plurality of input ends to receive a plurality of position code signals and comprises a plurality of source drivers, each of the source drivers is coupled to a timing controller for receiving a display timing data, each of the source drivers is coupled to one of the input ends of the source driver array and correspondingly receives one of the position code signals, each of the position code signals with respect to each of the source drivers is determined according to a driving sequence of the source drivers in the source driver array, the position code signal is used as a reference for a control signal of data distribution of a display data signal in the display timing data, and then being transmitted to the display panel, all of the position code signals being not provided by the source drivers, and each of the source drivers comprising a start pulse generating circuit, used to receive the position code signal, generate a start pulse signal according to the received position code signal, so as to serve as the control signal of data distribution of the display data signal in the display timing data, wherein the start pulse generating circuit comprises:

a start-code detection circuit, used to receive the display timing data transmitted from the timing controller, and detect whether or not a horizontal latch signal appears in the display timing data, after the horizontal latch signal has been detected, continuously to detect whether or not a start code appears in the display data signal of the display timing data, so as to generate an enabling signal after detecting the start code;

a synchronous counter, coupled to the start-code detection circuit, for receiving the enabling signal, the horizontal latch signal and an operation clock signal, wherein the horizontal latch signal resets a counting value of the synchronous counter to be 0, and starting to count according to the enabling signal;

a decoding circuit, for receiving the position code signal, and accordingly generating a source-driver encoding signal (POS); and a digital comparator, coupled to the synchronous counter and the decoding circuit, so as to compare the source-driver encoding signal (POS) with the counting value of the synchronous counter, wherein if the value of the source-driver encoding signal is equal to the counting value, then the display data signal in the display timing data starts to be received and thus the operation frequency of the source driver is enhanced.

11. The source driver array of claim 9, wherein the display timing data includes an operation clock signal, a horizontal latch signal, and the display data signal.

12. The source driver array of claim 11, wherein the operation clock signal, the display data signal, and the horizontal latch signal are differential voltage signal signals.

13. The source driver array of claim 11, wherein the operation clock signal, the display data signal, and the horizontal latch signal are transistor-transistor logic (TTL) voltage signal signals.

14. The source driver array of claim 10, wherein the position code signal has a plurality of bits, wherein the number of the bits of the position code signal is determined by the number of the source drivers.

15. The source driver array of claim 14, wherein the number of the bits of the position code signal is greater than or equal to the value of the number, which represents a number of bits for the number of source drivers by binary.

16. The source driver array of claim 10, wherein when the position code signal received by the source drivers in the source driver array is used as the control signal of data distribution of the display data signal in the display timing data, the source-driver encoding signal (POS) is generated to serve as a reference to start to receive the display data signal in the display timing data.

17. The source driver array of claim 16, wherein for the source-driver encoding signal (POS) with respect to an x-th one of the source drivers of the source driver array, a value of the source-driver encoding signal (POS) is (x−i)*k, wherein after the counting value is equal to the value of the source-driver encoding signal (POS), the one of the source drivers starts to receive the display data signal in the display timing data, wherein k represents the number of data to be latched in each of the source drivers, and x, i, and k are positive integers.

18. The source driver array of claim 16, wherein after data of one horizontal line of the display data signal in the display timing data are completely latched, the timing controller issues a horizontal latch signal to cause the data of the horizontal line to have digital-to-analog conversion, and then transmitted to the display panel.

19. A source driver, suitable for driving a display panel of a displaying apparatus, the source driver being used to receive a display timing data provided from a timing controller, the source driver comprising a start pulse generating circuit, used to receive a position code signal, generate a start pulse signal according to the position code signal, so as to serve as a control signal of data distribution of a display data signal in the display timing data, wherein the start pulse generating circuit comprises:

a start-code detection circuit, used to receive the display timing data transmitted from the timing controller, and detect whether or not a horizontal latch signal appears in the display timing data, after the horizontal latch signal has been detected, continuously to detect whether or not a start code appears in the display data signal of the display timing data, so as to generate an enabling signal after detecting the start code;

a synchronous counter, coupled to the start-code detection circuit, for receiving the enabling signal, the horizontal latch signal and an operation clock signal, wherein the horizontal latch signal resets a counting value of the synchronous counter to be 0, and starting to count according to the enabling signal;

a decoding circuit, for receiving the position code signal, and accordingly generating a source-driver encoding signal (POS); and a digital comparator, coupled to the synchronous counter and the decoding circuit, so as to compare the source-driver encoding signal (POS) with the counting value of the synchronous counter, wherein if the value of the source-driver encoding signal is equal to the counting value, then the display data signal in the display timing data starts to be received and thus the operation frequency of the source driver is enhanced.

20. The source driver of claim 19, wherein when the position code signal received by the source driver is used as the control signal of data distribution of the display data signal in the display timing data, a source-driver encoding signal (POS) is generated to serve as a reference to start to receive the display data signal in the display timing data.

21. The source driver of claim 20, wherein for the source-driver encoding signal (POS) with respect to an x-th one of the source driver, a value of the source-driver encoding signal (POS) is (x−i)*k, wherein after the counting value is equal to the value of the source-driver encoding signal (POS), the source driver starts to receive the display data signal in the display timing data, wherein k represents the number of data to be latched in each of the source drivers, and x, i, and k are positive integers.

22. The source driver of claim 21, wherein the number of data to be latched in the source driver is equal to the number of output channels in the source driver.

23. The source driver of claim 19, wherein after data of one horizontal line of the display data signal in the display timing data are completely latched, the timing controller issues a horizontal latch signal to cause the data of the horizontal line to have digital-to-analog conversion, and then transmitted to the display panel.

24. The source driver of claim 19, wherein after the digital comparator compares the source-driver encoding signal (POS) with the counting value of the synchronous counter, if the equal occurs, then a start pulse signal is exported for causing the source driver to start receive the display data signal in the display timing data.

25. The source driver of claim 19, wherein the synchronous counter is a rising-edge-trigger counter, and the counter starts to count when the enabling signal changes from a logic low voltage level to a logic high voltage level.

26. The source driver of claim 19, wherein the synchronous counter is a falling-edge-trigger counter, and the counter starts to count when the enabling signal changes from a logic high voltage level to a logic low voltage level.

27. A displaying apparatus, having a display panel and a driving circuit, wherein the driving circuit comprises a timing controller and a source driver array, wherein the source driver array has a plurality of input ends to receive a plurality of position code signals and comprises a plurality of source drivers, the timing controller is coupled with each of the source drivers and provides a display timing data to each of the source drivers, each of the source drivers is coupled to one of the input ends of the source driver array and correspondingly receives one of the position code signals, each of the position code signals with respect to each of the source drivers is determined according to a driving sequence of the source drivers in the source driver array, the position code signal is used as a reference for a control signal of data distribution of a display data signal in the display timing data, and then being transmitted to the display panel, all of the position code signals being not provided by the timing controller or one of the source drivers, and each of the source drivers comprising a start pulse generating circuit, used to receive the position code signal, generate a start pulse signal according to the received position code signal, so as to serve as the control signal of data distribution of the display data signal in the display timing data, wherein the start pulse generating circuit comprises:

a start-code detection circuit, used to receive the display timing data transmitted from the timing controller, and detect whether or not a horizontal latch signal appears in the display timing data, after the horizontal latch signal has been detected, continuously to detect whether or not a start code appears in the display data signal of the display timing data, so as to generate an enabling signal after detecting the start code;

a synchronous counter, coupled to the start-code detection circuit, for receiving the enabling signal, the horizontal latch signal and an operation clock signal, wherein the horizontal latch signal resets a counting value of the synchronous counter to be 0, and starting to count according to the enabling signal;

a decoding circuit, for receiving the position code signal, and accordingly generating a source-driver encoding signal (POS); and a digital comparator, coupled to the synchronous counter and the decoding circuit, so as to compare the source-driver encoding signal (POS) with the counting value of the synchronous counter, wherein if the value of the source-driver encoding signal is equal to the counting value, then the display data signal in the display timing data starts to be received and thus the operation frequency of the source driver is enhanced.

28. The displaying apparatus of claim 27, wherein the display timing data includes an operation clock signal, a horizontal latch signal, and the display data signal.

29. The displaying apparatus of claim 28, wherein the operation clock signal, the display data signal, and the horizontal latch signal are differential voltage signal signals.

30. The displaying apparatus of claim 28, wherein the operation clock signal, the display data signal, and the horizontal latch signal are transistor-transistor logic (TTL) voltage signal signals.

31. The displaying apparatus of claim 28, wherein the position code signal has a plurality of bits, wherein the number of the bits of the position code signal is determined by the number of the source drivers.

32. The displaying apparatus of claim 31, wherein the number of the bits of the position code signal is greater than or equal to the value of the number, which represents a number of bits for the number of source drivers by binary.

33. The displaying apparatus of claim 28, wherein when the position code signal received by the source drivers in the source driver array is used as the control signal of data distribution of the display data signal in the display timing data, the source-driver encoding signal (POS) is generated to serve as a reference to start to receive the display data signal in the display timing data.

34. The displaying apparatus of claim 33, wherein for the source-driver encoding signal (POS) with respect to an x-th one of the source drivers of the source driver array, a value of the source-driver encoding signal (POS) is $(x-i)*k$, wherein after the counting value is equal to the value of the source-driver encoding signal (POS), the one of the source drivers starts to receive the display data signal in the display timing data, wherein k represents the number of data to be latched in each of the source drivers, and x, i, and k are positive integers.

35. The displaying apparatus of claim 33, wherein after data of one horizontal line of the display data signal in the display timing data are completely latched, the timing controller issues a horizontal latch signal to cause the data of the horizontal line to have digital-to-analog conversion, and then transmitted to the display panel.

36. The displaying apparatus of claim 28, wherein the displaying apparatus is an active-drive displaying apparatus.

37. The displaying apparatus of claim 28, wherein the displaying apparatus is an amorphous-silicon thin-film-transistor liquid crystal display apparatus.

38. The displaying apparatus of claim 28, wherein the displaying apparatus is a low temperature polysilicon thin-film-transistor liquid crystal displaying apparatus.

39. The displaying apparatus of claim 28, wherein the displaying apparatus is a liquid crystal on Silicon (LcoS) displaying apparatus.

40. The displaying apparatus of claim 28, wherein the displaying apparatus is an organic light-emitting diode (OLED) displaying apparatus.

* * * * *